US005758697A

United States Patent [19]

Musha et al.

[11] Patent Number: 5,758,697

[45] Date of Patent: Jun. 2, 1998

[54] METHOD FOR WEAVING PATTERNS HAVING DIFFERENT YARN TYPES ALTERNATELY ARRANGED IN A 1/F FLUCTUATION

[75] Inventors: Toshimitsu Musha, 13-17, Minami-Tsukushino 2-chome, Machida-shi, Tokyo; Yuichi Yanai, Okazaki; Shoji Takagi, Okazaki; Shu Ono, Okazaki, all of Japan

[73] Assignees: Nisshinbo Industries, Inc.; Toshimitsu Musha, both of Tokyo, Japan

[21] Appl. No.: 646,949

[22] Filed: May 8, 1996

[30] Foreign Application Priority Data

May 10, 1995 [JP] Japan ..... 7-136187

[51] Int. Cl.[6] ..... D03D 13/00

[52] U.S. Cl. ..... 139/192; 139/1 R; 139/417; 139/116.1; 364/470.11; 364/140

[58] Field of Search ..... 139/1 R, 383 R, 139/417, 192, 116.1; 364/140

[56] References Cited

U.S. PATENT DOCUMENTS

| | | | |
|---|---|---|---|
| 3,696,845 | 10/1972 | Acker et al. | 139/417 |
| 4,495,560 | 1/1985 | Sugimoto et al. | 364/154 |
| 4,497,560 | 2/1985 | Nagaoka et al. | 354/403 |
| 5,243,267 | 9/1993 | Ogasawara | 318/590 |
| 5,396,413 | 3/1995 | Kaneko et al. | 364/140 |
| 5,570,725 | 11/1996 | Musha et al. | 139/192 |
| 5,598,875 | 2/1997 | Musha et al. | 139/192 |

FOREIGN PATENT DOCUMENTS

| | | | |
|---|---|---|---|
| 0 686 716 | 12/1995 | European Pat. Off. . | |
| 1324430 | 3/1963 | France . | |
| 588811 | 12/1932 | Germany | 139/192 |
| 464307 | 3/1949 | Italy | 139/192 |
| 0028548 | 2/1985 | Japan | 139/192 |
| 0045647 | 3/1985 | Japan | 139/192 |
| 1527342 | 12/1989 | U.S.S.R. | 139/192 |

OTHER PUBLICATIONS

"Bioinformation and 1/f Fluctuation", applied Physics, 1985, pp. 429–435. (Which corresponds to partial translation, Physics Of The Living State, Ohmasha, 1994).

"Biocontrol and /1f Fluctuation" Jouranl of Japan Society of Precision Machinery, 1984, vol. 50 No. 6. (Which corresponds to partial translation, Computer Analysis of cardiovascular signals Chapter 6 1/f fluctuations of the Biological Rhythm, *1/f Fluctuations of the Biological Rhythm*, IOS Press, 1995).

"the World of Fluctuations" by Kodansha Publisher (Which corresponds to partial translation, 1/f–Like fluctuations of Biological Rhythm, Musha, Brain Functions Laboratory, Japan) No date Supplied.

"Seitai Shingo, Chapter 10, Biological Rhythm", Chapter 10, with a translation of section 2–4 in Chapter 10, (partial translation of Seitai Shingo, section 2–4 in Chapter 10), (Which corresponds to partial translation, Biological Signals—Actual Measurement and Analysis—, Corona Publishing Co., Ltd.) No date Supplied.

*Primary Examiner*—Andy Falik

*Attorney, Agent, or Firm*—Nikaido, Marmelstein, Murray & Oram LLP

[57] ABSTRACT

A weaving method that imparts a 1/f fluctuation to the weave pattern. Adjacent and different numbered groups of different yarns, for example black yarn and white yarns, are alternately arranged in contiguous reed dents. The sequential number which is associated with each group manifests a series of numbers which effect the 1/f fluctuation. Following separation of the warp yarns into two sets by raising and lowering of healds to form a shed and passage of weft yarns therethrough, a woven fabric with a stripped 1/f fluctuation in the warp direction is created.

8 Claims, 3 Drawing Sheets

METHOD FOR WEAVING PATTERNS HAVING DIFFERENT YARN TYPES ALTERNATELY ARRANGED IN A 1/F FLUCTUATION

BACKGROUND OF THE INVENTION

This invention relates to a weaving method using a number of different types of yarn that imparts a pattern using a 1/f fluctuation.

The conventional weaving method using different types of pre-dyed yarn produces either a constant pattern or a totally random pattern of warp yarns and weft yarns.

Conventional weaving methods produce woven goods in which the warp yarns and weft yarns are of a uniform pattern or of a completely random pattern, and therefore do not have a natural, irregular feel. The goods instead have an artificial texture with very little natural feel and is not particularly comfortable for the wearer.

DETAILED DESCRIPTION OF THE INVENTION

The present invention overcomes this problem and provides yarns of one type of warp yarn, for example white yarn, that are grouped in numbers corresponding to the values of a numerical sequence having a 1/f fluctuation and passed through reed dents so as to alternate with yarns of another type of warp yarn, for example, black yarn, then the warp yarn are separated into two sets to form a shed between two sets, and weft yarns are passed through the shed, thereby weaving the warp yarns and weft yarns such that a striped pattern with a 1/f fluctuation is imparted to the warp yarns.

The present inventor, Toshimitsu Musha, was the first in the world to discover that a 1/f fluctuation would impart a particularly comfortable feel to humans. The results were published in "The World of Fluctuations", released by Kodanasha Publishers in 1980; and were also announced in a paper entitled "Bioinformation and 1/f Fluctuation", Applied Physics, 1984, pp 429–435, and another paper titled "Biocontrol and 1/f Fluctuation", Journal of Japan. Soc. of Precision Machinery, 1984, vol 50, No. 6, as well as in a recent publication called "the Concept of Fluctuations", published by NHK in 1994. The abstract of these publications read, > the 1/f fluctuation provides a comfortable feeling to humans; the reason being that the variations in the basic rhythm of the human body have a 1/f spectrum. From another perspective, the human body eventually tires of a constant stimulation from the same source, but conversely, the body feels uncomfortable if the stimulations were to change too suddenly; therefore a 1/f fluctuation is a fluctuation of the right proportion between these two extremes.

An excerpt from "The World of Fluctuations", published by Kodansha Publishers, reads > For example, the rhythms exhibited by the human body such as heart beats, and hand-clapping to music, impulse- release period of neurons, and a-rhythms observed in the brain, are all basically 1/f fluctuations, and it has been shown experimentally that if a body is stimulated by a fluctuation like these biorhythmic 1/f fluctuations, it would feel comfortable.

Fluctuations (variations) exist in various forms throughout nature, but the murmur of a brook, a breath of wind, and other phenomena that impart a comfortable feeling to humans have a 1/f fluctuation, while typhoons and other strong winds that impart uneasiness do not have a 1/f fluctuation.

The present invention is designed to take advanatge of the benefits of 1/f fluctuations. The objectives of the present invention are as follows:

1. An objective of this invention is to make woven goods available that provide a natural, comfortable feeling to human beings.

2. Another objective of this invention is to provide a weaving method which causes the pattern of woven goods made from a number of different types of yarn to have a correlation, specifically, a 1/f fluctuation.

3. Another objective of this invention is to provide a method to produce woven goods with a natural, irregular feel on an industrial scale.

In this invention, "1/f fluctuation" is defined as a power spectrum, with a frequency component f, and proportional to $1/f^k$, where k is approximately 1, and similar spectra thereof. Yarn types is defined as yarns that vary by color such as pre-dyed yarns; by type of fiber such as cotton, linen, silk, wool or other natural fibers, rayon or other regenerated fibers, acetate or other semi-synthetic fibers, and polyester, polyamide or other synthetic fibers; by thickness; by twist count, or by twist direction; or by any combination of these types thereof.

This invention provides a weaving method for weaving woven goods from weft yarns and a number of different types of warp yarns; wherein, yarns of a first type of warp yarn are grouped in numbers corresponding to values of a numerical sequence having a 1/f fluctuation and passed through reed dents so as to alternate with yarns of a second type of warp yarn, then the weft yarns are passed through the shed, thereby weaving the warp yarns and weft yarns such that a 1/f fluctuation is imparted to the warp yarn pattern. Alternatively, the yarns of the second type are also grouped in numbers corresponding to the values of a numerical sequence having a 1/f fluctuation.

This invention also provides a weaving method for weaving woven goods from warp yarns and a number of different types of weft yarns; wherein warp yarns are passed through reed dents, the warp yarns are separated into two sets to form a shed between the two sets, and in passing the weft yarn through the shed, yarns of a first type of weft yarn are selected in groups in number corresponding to the values of a numerical sequence having a 1/f fluctuation, and the groups are alternated with yarns of a second type of selected weft yarn, thereby weaving the warp yarns and weft yarns such that a 1/f fluctuation, is imparted to the weft yarn pattern. Alternatively, the yarns of the second type of weft yarns are also grouped in numbers corresponding to the values of a numerical sequence having a 1/f fluctuation.

Another embodiment of this invention provides a weaving method for weaving woven goods from a number of different types of weft yarns and a number of different types of warp yarns; wherein, yarns of a first type of warp yarn are grouped in numbers corresponding to the values of a numerical sequence having a 1/f fluctuation and passed through the reed dents so as to alternate with yarns of a second type of warp yarn, then the warp yarns are separated into two sets to form a shed between the two sets, and in passing the weft yarn through the shed, yarns of a first type of weft yarn are selected in groups in numbers corresponding to the values of a numerical sequence having a 1/f fluctuation, and the groups are alternated with yarns of a second type of selected weft yarn, thereby weaving the warp yarns and weft yarns such that a 1/f fluctuation is imparted to the weft yarn pattern. Alternatively, the second type of warp yarn, the second type of weft yarn, or one type of warp yarn and one type of weft yarn are also grouped in numbers corresponding to the values of a numerical sequence having a 1/f fluctuation.

This invention is effective in that:

1. The pattern of the woven fabric does not change randomly; rather it has a correlation, and because this correlation has a 1/f fluctuation, it imparts a special feeling of comfort and aesthetic beauty to the wearer.

2. Woven goods with a hand-woven natural irregular feel can be manufactured at low cost on an industrial scale.

3. Incorporating a melody or tone having a 1/f fluctuation into woven goods can evoke a feeling of comfort in the wearer.

BRIEF EXPLANATION OF THE FIGURES

The above and other objects and the attendant advantages of the present invention will become readily apparent by reference to the following detailed description when considered in conjunction with the accompanying drawings wherein.

DETAILED DESCRIPTION OF THE INVENTION AND OF THE PREFERRED EMBODIMENT

Working examples of this invention will be explained below.

Figure 1:
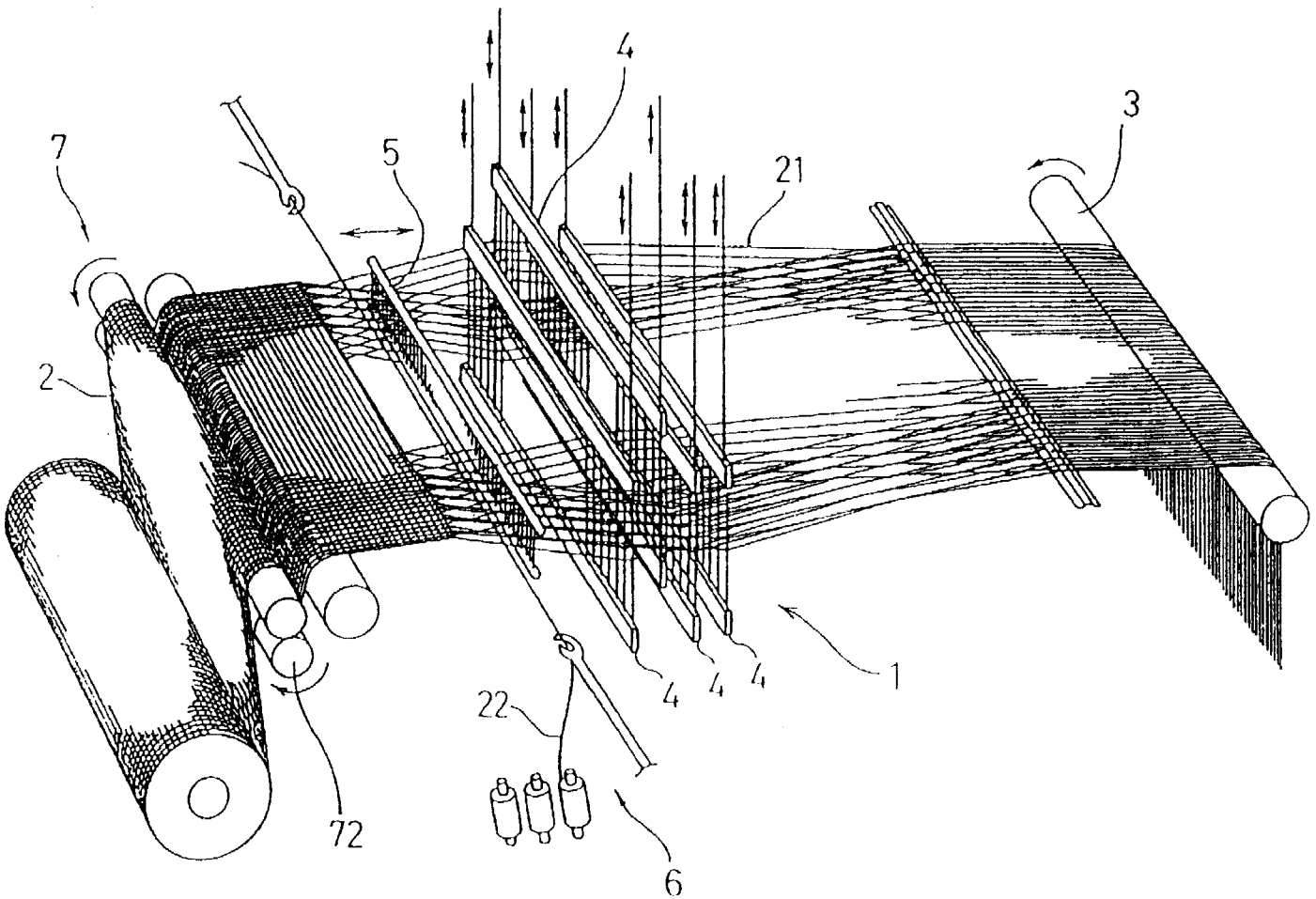
FIG. 1 is an overview diagram of the principal components of a weaving machine.

1. Overview of a weaving machine Weaving machine 1 weaves spun yarn into woven goods 2 through the primary movements of opening the shed, inserting the weft yarn, and beating the weft, and the secondary movements of letting off warp yarns 21 and taking up woven goods 2. It is constructed, for example, as shown in FIG. 1. The action of opening the shed divides all the warp yarns into two sets, forming an opening through which weft yarn 22 passes, and causing warp yarns 21 and weft yarns 22 to cross over each other. For this purpose, warp yarns 21 are drawn-in through two sets of healds 4 in a prescribed order, and the up and down action of these healds 4 separates the warp yarns 21 vertically.

In one method of weft insertion, the weft yarn is fixed in the end of a rapier 6 which carries the weft yarn through the shed formed by the warp yarns. In addition to a rapier, other methods of weft insertion use air, water, shuttles grippers, or other means. A number of different types of weft yarn, for example, pre-dyed yarns of different color, can be selected to weave a colored pattern among the weft yarns.

Weft beating is the procedure in which the reed presses and forces the weft yarn 22, which has passed through the inside of the shed formed by the warp yarns, up to a prescribed position, thereby causing warp yarn 21 and weft yarn 22 to cross each other. The let-off device 3 gradually feeds the warp yarns 21, while the take-up device 7 rolls up the woven goods 2.

2. Obtaining 1/f fluctuation signals 1/f fluctuation signals may be derived from a numerical sequence y1, y2, y3, . . . formed by multiplying n coefficients, a1, a2, a3, . . . $a_n$, on a random sequence of numbers, x1, x2, x3, . . . Generally, $y_j$ can be expressed by Equation 1. Here, the sequence of numerical values forming y1, y2, y3, . . . has a 1/f spectrum. (For further details, refer to 'Biological Signaling', Chapter 10, in "Biological Rhythms and Fluctuations", published by Corona Publishers, Ltd.)

$$y_j = x_j + \left(\frac{1}{2}\right)x_{j-1} + \left(\frac{1*3}{2^2*2!}\right)x_{j-2} + \left(\frac{1*3*5}{2^3*3!}\right)x_{j-3} + \ldots + \left(\frac{1*3*5*\ldots*(2n-1)}{2^{n-1}*(n-1)!}\right)x_{j-n+1} \quad (1)$$

The sequence of numerical values having a 1/f fluctuati.on may be obtained in two steps. In step 1, a computer, for example, generates a sequence of random numbers, x. In step 2, a certain number, n, of coefficients, a, stored in a storage device, are successively multiplied on the random numbers, and then a sequence of numerical values, y, is obtained by a linear transformation. This numerical sequence, y, has a 1/f spectrum, and can be used as a sequence of numerical values having a 1/f fluctuation. Examples of numerical sequences with a 1/f fluctuation so obtained are shown below. Other numerical sequences with a 1/f fluctuation can be derived, for example, from a sound, melody, or a breath of wind, the strengths of which varies with a 1/f fluctuation.

Numerical sequence 1=32, 18, 24, 14, 10, 20,16,16, 12,4, 14, 16, 16, 8, 24, 4, 10, 28, 28, 12, 10, 2, 2, . . .

Numerical sequence 2=4, 8, 10, 40, 24, 4, 12, 16, 20, 16, 24, 8, 8, 14, 14, 22, 26, 4, 8, 14, 14, 26, 28, . . .

Numerical sequence 3=20, 20, 26, 10, 10, 24, 18, 24, 12, 6, 12, 16, 16, 10, 24, 6, 12, 32, 12, 12, . . .

Numerical sequence 4=6, 6, 10, 40, 22, 4, 10, 12, 12, 12, 24, 6, 6, 12, 12, 20, 28, 8, 12, 60, . . .

Numerical sequence 5=8, 8, 20, 20, 8, 4, 18, 6, 9, 9, 8, 3, 9, 11, 10, 15, 8, 10, . . .

Numerical sequence 6=43, 8, 5, 2, 16, 12, 8, 8, 5, 5, 18, 9, 9, 8, 6, 2, 15, 25, 5, 5, 4, . . .

3. Weaving patterned warp yarns

Weaving using a number of different types of warp yarn will produce woven goods in which the warp yarns are patterned as a function of the type of yarn. Warp yarn types can vary by color such as pre-dyed yarns; by type of fiber such as cotton, linen, silk, wool or other natural fibers, rayon or other regenerated fibers, acetate or other semi-synthetic fibers, and polyester, polyamide or other synthetic fibers; by thickness; by twist count, or by twist direction; or by any combination of these types thereof.

For example, to produce a colored striped pattern in the warp yarns, white and black dyed yarns for example, can be prepared for use as the warp yarns, and the white yarn can be prepared for use as the weft yarns. Then, for example, starting at one end of the weaving machine, white warp yarns can be grouped in accordance with numerical sequence 1 described above. That is, 32 white yarns are arranged contiguously, then 18 yarns, then 24, then 14 yarns, and so forth. Similarly, the black warp yarns are grouped but in accordance with numerical sequence 2; that is, 4 yarns are arranged contiguously, then 8 yarns, then 10, then 40 yarns, and so forth. These white and black groups of yarns are arranged in alternate groups of reed dents. That is, starting at one end, reed dents having a total of 32 white yarns (numerical sequence 1), reed dents having a total of 4 black yarns (numerical sequence 2), reed dents having a total of 18 white yarns (numerical sequence 1) reed dents having a total of 8 black yarns (numerical sequence 2), reed dents having a total of 24 white yarns (numerical sequence 1), reed dents having a total of 10 black yarns (numerical sequence 2) and so forth are inserted in order in contiguous groups of reed dents.

As a more detailed example using a conventional practice of two yarns being passed through each reed dent, the above explicit example would be as follows. That is, starting at one end of the reed, 16 reed dents are occupied by 32 white yarns conventionally reeded in pairs to form the first number in numerical sequence 1. This group of yarns is followed by a second yarn group consisting of four black yarns which are reeded into two dents and which define the first number in numerical sequence 2. 18 white yarns are then reeded in the same manner to form the second number defining numerical sequence 1, followed by 8 black yarns (second number in sequence 2), 24 white yarns (third number in sequence 1), 10 black yarns (third number in sequence 2), and so forth.

Figure 2:
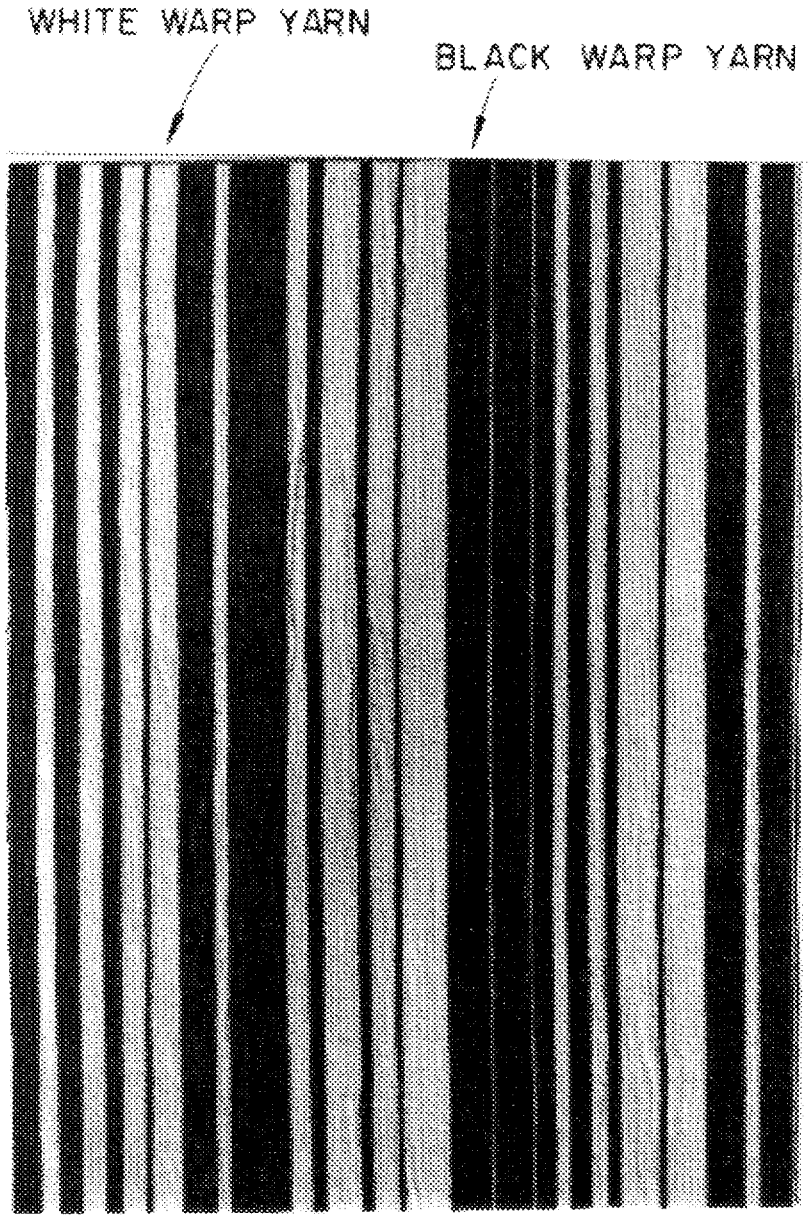
FIG. 2 illustrates a striped colored pattern with a 1/f fluctuation.

Weaving white weft yarns into warp yarns arranged in this manner will produce a black-and-white striped pattern as shown in FIG. 2. This pattern of stripes is not random, but has a correlation of a 1/f fluctuation.

In another example, to obtain a different striped pattern with a 1/f fluctuation, white warp yarns can be grouped in accordance with a numerical sequence having a 1/f fluctuation, while a constant number of black yarns, for example, 5 yarns, are grouped. The groups are then alternated as described above. In this case, the variation in the width of the white stripes has a 1/f fluctuation.

Alternatively, white yarn and black yarn can each be grouped in accordance with a common numerical sequence. For example, white yarns and black yarns can be allocated in accordance with alternate values of numerical sequence 1; that is 32 white yarns, 18 black yarns, 24 white yarns, and so forth are arranged in order in contiguous reed dents to obtain a pattern with a 1/f fluctuation. Or, three or more colors can be arranged alternately in a numerical sequence having a 1/f fluctuation.

4. Weaving of patterned weft yarns

Like warp yarns, a number of different types of weft yarn can be woven to produce woven goods in which the weft yarns are patterned. For example, to obtain a colored striped pattern in the weft yarns, two pre-dyed yarns of different color are prepared for the weft yarns and pre-dyed yarn of a single color is prepared for the warp yarns.

Then any generally known weaving machine such as a rapier loom fitted with a selection device which can be programmed to select different weft yarns, can be used for the weaving process. For example, the selection device is mounted on the loom and controlled so that white yarns will be selected in accordance with numerical sequence 1, while black yarns will be selected in accordance with numerical sequence 2. That is, 32 white yarns (numerical sequence 1) are selected as one group, then four black yarns (numerical sequence 2) are selected as a group, followed in order by 18 white yarns (numerical sequence 1), 8 black yarns (numerical sequence 2), 24 white yarns (numerical sequence 1), 10 black yarns (numerical sequence 2) and so forth in alternate groups of white and black order.

Weaving in this manner will produce a fabric with a striped pattern with a 1/f fluctuation as shown in FIG. 2, except that the warp yarns and weave yarns are reversed. And like the warp yarns, other different types of weft yarns can be used to produce different patterns, all with a 1/f fluctuation.

5. Weaving of patterned warp yarns and weft yarns

Figure 3:
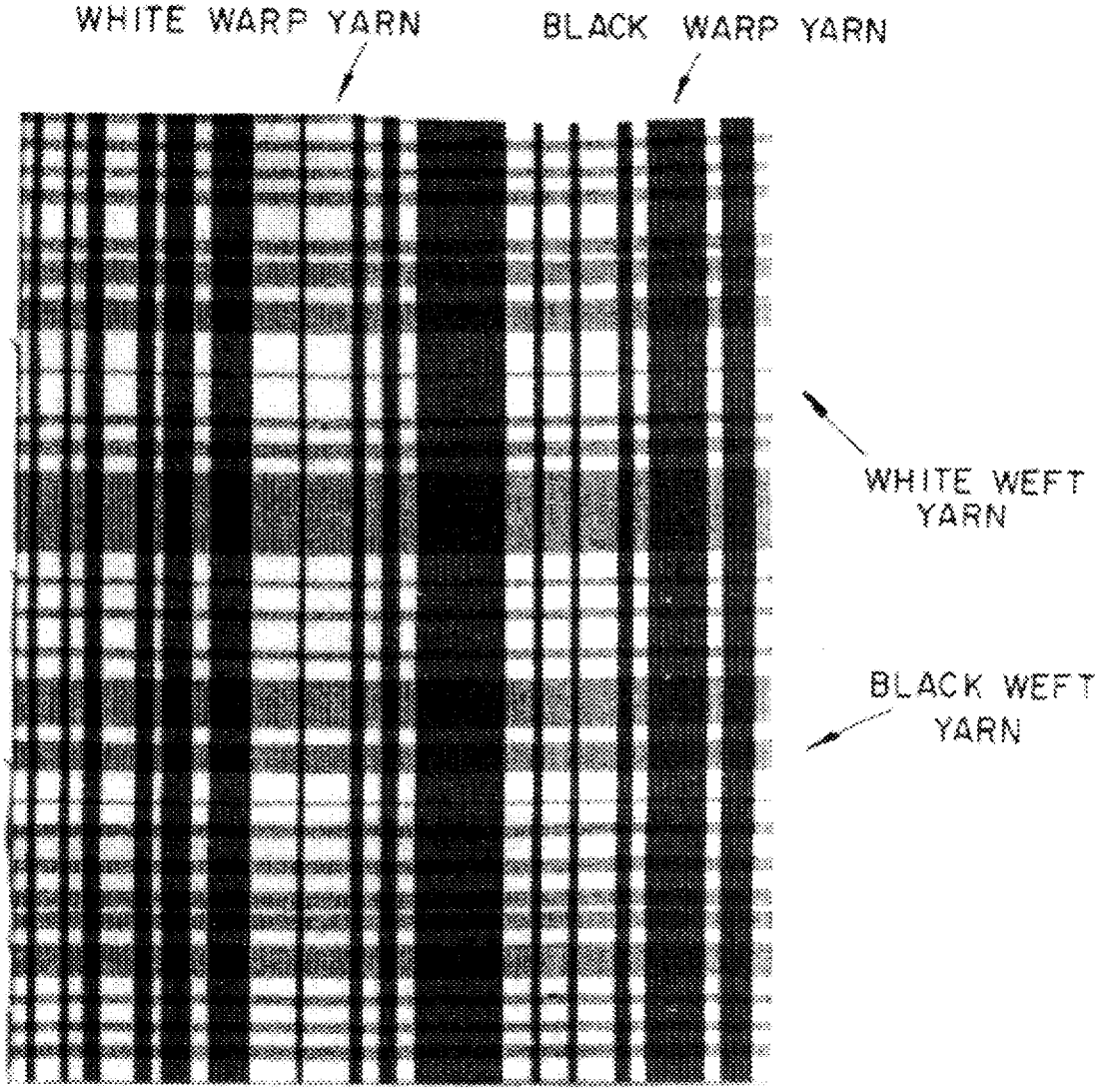
FIG. 3 illustrates a checkered colored pattern with a 1/f fluctuation.

Patterns can also be produced in both the warp yarns and the weft yarns. For example, the weaving method to impart a colored striped pattern in the warp yarns and the weaving method to impart a colored striped pattern in the weft yarns as described above can be combined to produce a checkered pattern as shown in FIG. 3. In this case, the black stripes in the warp yarns are much darker than the black stripes in the weft yarns. This arises because the density of the warp yarns is greater than that of the weft yarns. If the yarn density of the warp yarns are the same, then the color density will be uniform.

To produce the woven fabric of FIG. 3, white and black pre-dyed yarns are prepared for both the warp yarns and weft yarns. Then for example, white yarns and black yarns are grouped in accordance with numerical sequence 3 and numerical sequence 4 respectively for use as the warp yarns, and a white group and black group are arranged in alternate groups of reed dents. Similarly, white yarns and black yarns are grouped in accordance with numerical sequence 5 and numerical sequence 6 respectively for use as the weft yarns, and a white group and a black group are selected alternately. That is, for the warp yarns, 20 white yarns (numerical sequence 3), 6 black yarns (numerical sequence 4), 20 white yarns (numerical sequence 3), 6 black yarns (numerical sequence 4), and so forth are arranged in order in alternate dents. For the weft yarns, 43 black yarns (numerical sequence 6), 8 white yarns (numerical sequence 5), 8 black yarns (numerical sequence 6), 8 white yarns (numerical sequence 5), 5 black yarns (numerical sequence 6) and so forth are selected in alternate order.

Weaving in this manner produces a pattern with a 1/f fluctuation in both the warp yarns and weft yarns for an overall checkered pattern with a 1/f fluctuation. Other patterns can be produced similarly.

6. Weaving of patterned weft yarns where the weft yarns and warp yarns are of a different type In this example, cotton weft yarns and polyester warp yarns are woven with a shuttle weaving machine equipped with 6 healds. White polyester yarn is used for the warp yarns, and a selection device is mounted and controlled such that white yarns are selected in accordance with numerical sequence 1 and black yarns are selected in accordance with numerical sequence 2. By using very elastic warp yarn and weft yarn of much lower elasticity, a woven fabric and be produced with a striped pattern with a 1/f fluctuation in which the warp yarns are finely crinkled.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

We claim:

1. A weaving method for weaving woven goods having a 1/f fluctuation from weft yarns and a number of different types of warp yarns comprising:

grouping yarns of a first type of warp yarn in numbers corresponding to values of a first numerical sequence having a 1/f fluctuation, wherein a plurality of yarn groups each having a different 1/f value is created;

passing the grouped yarns and yarns of a second type of warp yarn through reed dents so as to alternate each of the different 1/f groups with the yarns of the second type;

separating the warp yarns in the reed dents into two sets by raising and lowering healds to form a shed between two sets; and passing weft yarns through the shed, thereby weaving the warp yarns and weft yarns such that a 1/f fluctuation is imparted to a stripped warp yarn pattern.

2. A weaving method for weaving woven goods having a 1/f fluctuation as claimed in claim 1, further comprising:

grouping yarns of the second type of warp yarns in numbers corresponding to values of a second numerical sequence having a 1/f fluctuation.

3. A weaving method for weaving woven goods having a 1/f fluctuation from warp yarns and a number of different types of weft yarns, comprising:

passing warp yarns through reed dents;

separating the warp yarns in two sets to form a shed by raising and lowering healds between the two sets;

selecting yarns of a first type of weft yarn in groups having numbers corresponding to values of a first numerical sequence having a 1/f fluctuation, wherein a plurality of yarn groups having a different 1/f value is created;

alternating the groups of the first type of weft yarn with yarns of a second type of weft yarn;

passing the alternating weft yarns through the shed, thereby weaving the warp yarns and weft yarns such that a 1/f fluctuation is imparted to a stripped weft yarn pattern.

4. A weaving method for weaving woven goods having a 1/f fluctuation as claimed in claim 3, further comprising:

grouping the second type of weft yarns grouped in numbers corresponding to values of a second numerical sequence having a 1/f fluctuation.

5. A weaving method for weaving woven goods having a 1/f fluctuation form a number of different types of weft yarns and a number of different types of warp yarns, comprising:

grouping yarns of a first type of warp yarn in numbers corresponding to values of a numerical sequence having a 1/f fluctuation, wherein a plurality of warp yarn groups each having a different 1/f value is created;

passing the grouped yarns and yarns of a second type of warp yarn through reed dents so as to alternate the grouped yarns with the yarns of the second type;

separating the warp yarns in the reed dents into two sets by raising and lowering healds to form a shed between two sets;

selecting yarns of a first type of weft yarn in groups having numbers corresponding to values of a second numerical sequence having a 1/f fluctuation, wherein a plurality of weft yarn groups each having a different 1/f value is created;

alternating the groups of the first type of weft yarn with yarns of a second type of weft yarn;

passing the alternating weft yarns through the shed, thereby weaving the warp yarns and weft yarns such that a 1/f fluctuation is imparted to a warp yarn pattern and a stripped weft yarn pattern.

6. The weaving method for weaving woven goods having a 1/f fluctuation from a number of different types of weft yarns and a number of different types of warp yarns as claimed in claim 5, further comprising:

grouping yarns of the second type of warp yarns in numbers corresponding to values of a third numerical sequence having a 1/f fluctuation.

7. The weaving method for weaving woven goods having a 1/f fluctuation from a number of different types of weft yarns and a number of different types of warp yarns as claimed in claim 5, further comprising:

grouping the second type of weft yarns grouped in numbers corresponding to values of a third numerical sequence having a 1/f fluctuation.

8. The weaving method for weaving woven goods having a 1/f fluctuation from a number of different types of weft yarns and a number of different types of warp yarns as claimed in claim 5, further comprising:

grouping yarns of the second type of warp yarns in numbers corresponding to values of a third numerical sequence having a 1/f fluctuation; and grouping the second type of weft yarns grouped in numbers corresponding to values of a fourth numerical sequence having a 1/f fluctuation.

* * * * *